US005224707A

United States Patent [19]

Martin

[11] Patent Number: 5,224,707

[45] Date of Patent: Jul. 6, 1993

[54] SECURITY SYSTEM FOR A GAMING DEVICE

[75] Inventor: John R. Martin, Rockford, Ill.

[73] Assignee: Arachnid, Inc., Rockford, Ill.

[21] Appl. No.: 848,376

[22] Filed: Mar. 9, 1992

[51] Int. Cl.[5] ..... G07F 17/34; E05B 39/00

[52] U.S. Cl. ..... 273/143 R; 70/280; 70/DIG. 30

[58] Field of Search ..... 273/138 A, 143 R; 70/276, 277, 279, 280, DIG. 30

[56] References Cited

U.S. PATENT DOCUMENTS

| | | | |
|---|---|---|---|
| 4,132,439 | 1/1979 | Millar | 70/279 |
| 4,640,108 | 2/1987 | Young | 70/280 |
| 4,795,155 | 9/1989 | Grande | 273/143 R |
| 4,909,053 | 3/1990 | Zipf | 70/380 |

*Primary Examiner*—Benjamin H. Layno

*Attorney, Agent, or Firm*—McAndrews, Held & Malloy, Ltd.

[57] ABSTRACT

A security system for a gaming device prevents a door on the gaming device from being opened during a power failure so as to prevent tampering with the controls of the gaming device when no power is supplied to the system. When power is supplied to the system, a processor logs the time of occurrence of detected door openings in a nonerasable programmable memory so as to provide a record thereof. The information is stored in a sequential manner in accordance with the time of occurrence of the door opening events so that the microprocessor can verify the information stored. If any anomalies are detected in the stored information, the microprocessor 10 can prevent operation of the gaming device or generate alarms.

16 Claims, 3 Drawing Sheets

SECURITY SYSTEM FOR A GAMING DEVICE

TECHNICAL FIELD

Tne invention relates to a security system for a gaming device and more particularly to a system that prevents access to the controls of a gaming device during a power failure, the system recording the times of occurrence of a door opening event in a non-erasable programmable memory when power is supplied to the gaming device to provide a tamper-resistant record of such events.

BACKGROUND OF THE INVENTION

Known gaming devices typically have a locked door through which access to the controls of the gaming device may be attained. In order to monitor the door during a power failure, systems have been developed such as disclosed in U.S. Pat. No. 4,795,155 that detect during a power failure whether a door on the gaming device is open and, if it is, the system stores a signal in a latch indicative thereof. Upon the restoration of power, a processor in the game control circuitry reads the contents of the latch to determine whether the door was opened during the power failure and, if so, the processor prevents further operation of the gaming device. Such systems are fairly costly, however, and do not provide detailed records of door opening events.

SUMMARY OF THE INVENTION

In accordance with the present invention, the disadvantages of prior security systems for gaming devices, as discussed above, have been overcome. The system of the present invention prevents a door on a gaming device from being opened during a power failure, and whenever power is supplied to the gaming device, the system records the times of occurrence of each door opening event in a memory that is tamper-resistant.

More particularly, the system of the present invention includes a lock member mounted relative to the cabinet and door of the gaming device. The lock member in a first position prevents the door of the gaming device from being opened, the lock member being movable to a second position to allow the door to be opened. A device that is operable during a power failure interferes with the lock member to prevent movement of the lock member from the first position to the second position so as to prevent the door of the gaming device from being opened. When power is restored, the power down interfering device moves out of interference with the lock member to allow the lock member to be moved to the second position.

The system of the present invention also includes a switch device mounted relative to the door of the gaming device to detect the opening of the door and to provide a door open signal in response thereto. The game controller is responsive to a door open signal to store in a non-erasable programmable memory information representing the time of occurrence of a detected door opening event. The information is stored in a manner to allow the information to be verified. If anomalies in the stored information are detected, operation of the gaming device is prevented and/or alarms are generated.

These and other objects and advantages of the invention, as well as details of an illustrative embodiment, will be more fully understood from the following description and the drawings.

BEST MODE FOR CARRYING OUT THE INVENTION

Figure 1:
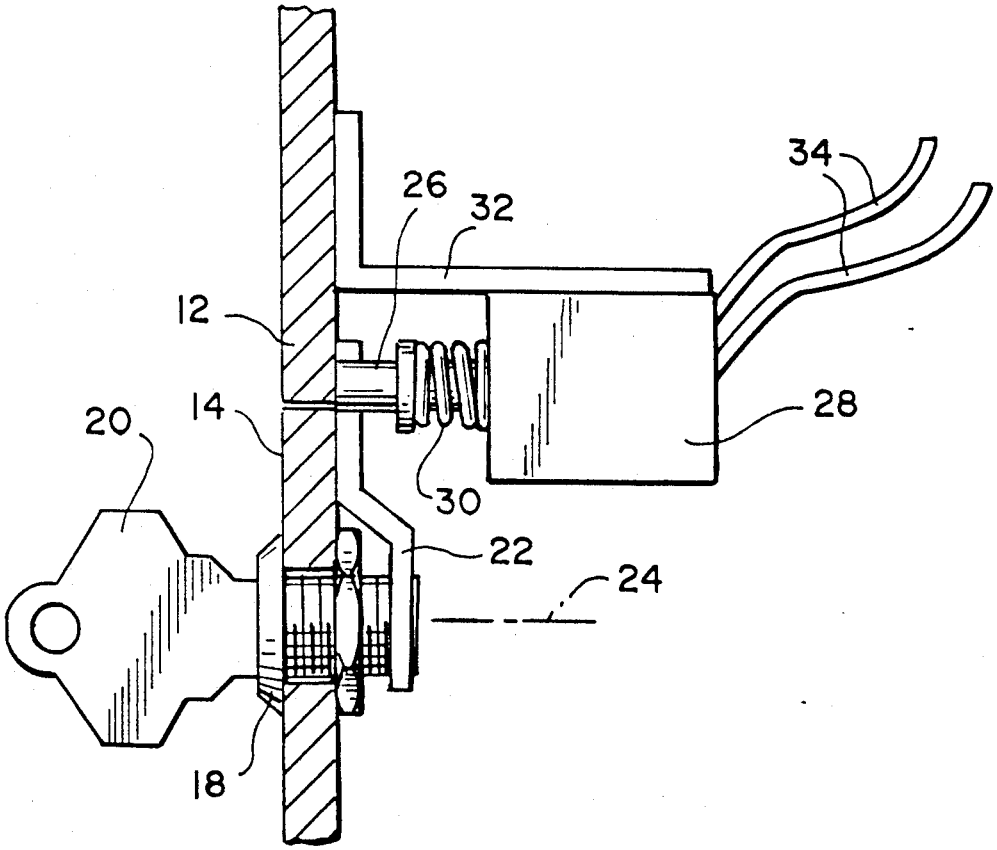
FIG. 1 is a partial perspective view of the cabinet and door of a gaming device illustrating the system of the present invention for preventing the door from being opened during a power failure.
Figure 2:
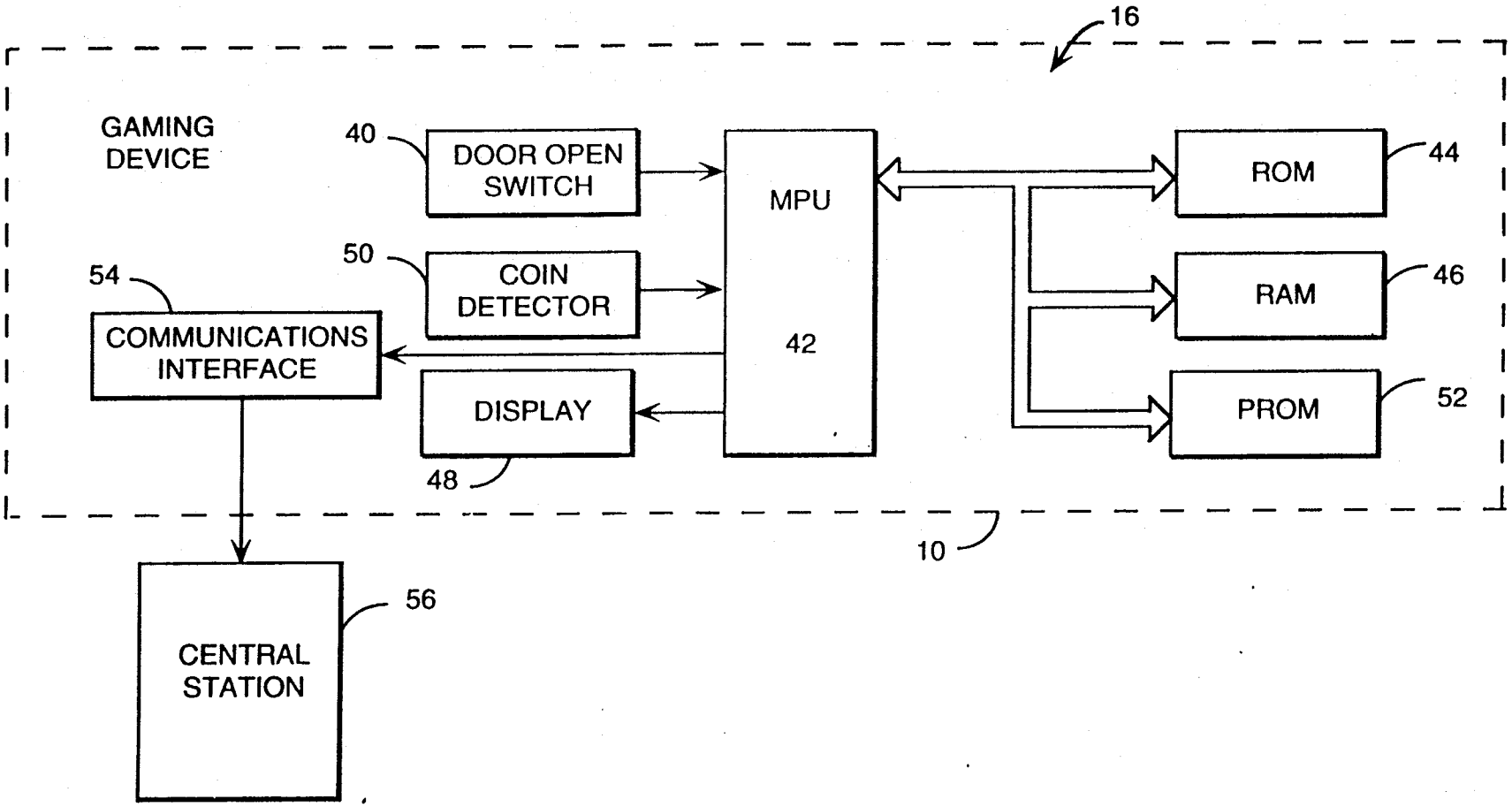
FIG. 2 is a block diagram of a gaming device in accordance with the present invention.

A gaming device 10 as illustrated in FIGS. 1 and 2 includes a cabinet 12 and a door 14 through which access to the controls, generally designated 16, of the gaming device may be had. The door 14 includes a lock 18 that is unlocked by a key 20 rotating a lock tang 22 about an axis 24 of the lock 18 in a direction towards a plunger 26 of a solenoid 28 so as to allow the door 14 to be opened when the plunger 26 is in a compressed position. The solenoid 28 is mounted to an inner wall of the cabinet 12 by a bracket 32 so that when the plunger 26 is in an extended position, the plunger 26 interferes with the rotation of the lock tang 22.

More particularly, when power is supplied to the solenoid 28 via a pair of leads 34, the solenoid 28 applies a force on the plunger 26 to pu 11 the plunger 26 in towards the body of the solenoid 28, overcoming the force of a spring 30 that biases the plunger 26 towards the cabinet 12 of the gaming device. When the plunger 26 is pulled in towards the body of the solenoid 28, the plunger 26 is not in an interfering relationship with the lock tang 22. Therefore when power is applied to the solenoid 28, the lock tang 22 can be rotated by the key 20 past the plunger 26 to open the door 14. During a power failure, the solenoid 28 does not exert a force on the plunger 26 so that the plunger 26 is biased by the spring 30 towards the cabinet 12. When the plunger 26 is biased towards the cabinet 12 during a power failure, the plunger 26 interferes with the lock tang 24 so as to prevent the door 14 from being opened by the key 20 during the power failure.

In order to monitor the opening of the door 14 while power is applied to the gaming device 10 and thus to the solenoid 28, the gaming device 10 includes a door open switch 40 as depicted in FIG. 2. The door open switch 40 may be any switch that is commonly used to detect the opening of a door and which provides a signal that may be coupled to a processor such as the microprocessor 42 of the gaming device 10. The microprocessor 42 controls the operation of the gaming device 10 in accordance with software and data respectively stored in a ROM 44 and a RAM 46. More particularly, the microprocessor 42 controls a video display 48 which interfaces with a player to present a game in response to the deposit of the correct coins as detected by a coin detector 50.

Figure 3:
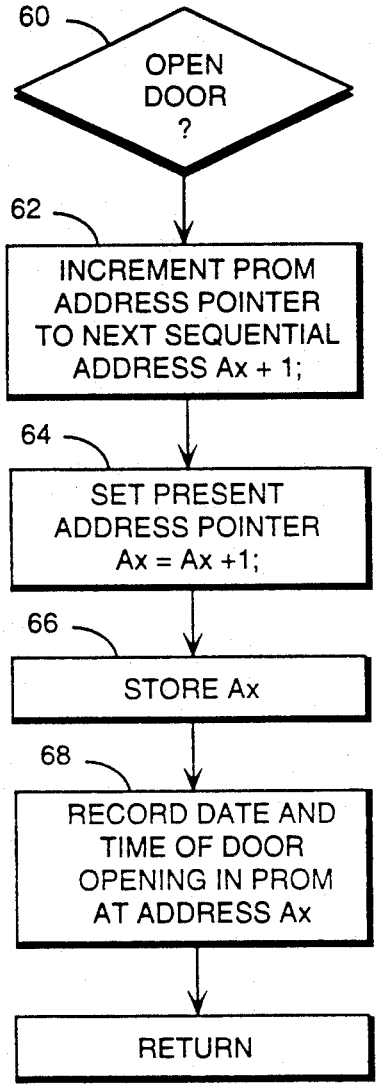
FIG. 3 is a flow chart illustrating a routine for recording door open events in a non-erasable programmable memory.
Figure 4:
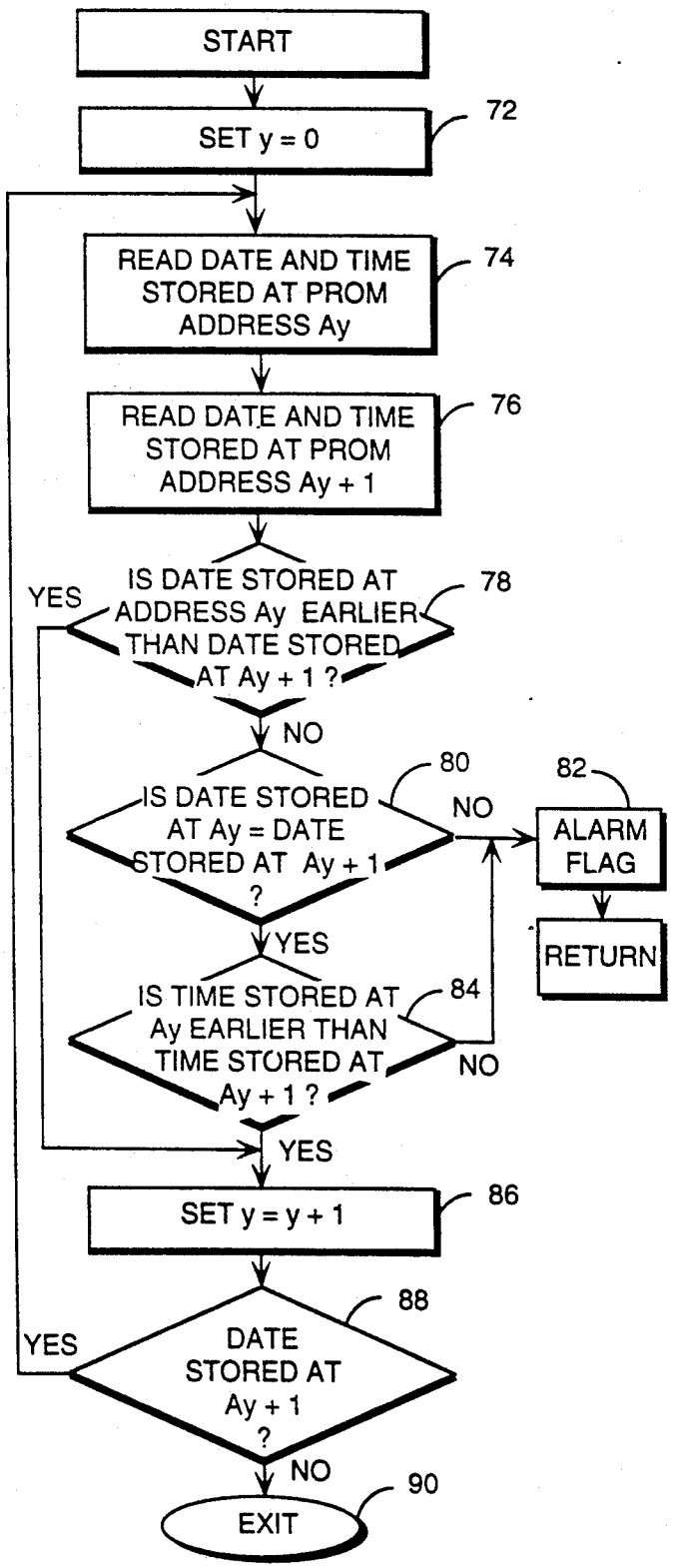
FIG. 4 is a flow chart illustrating a routine for checking recorded door open event records for verification thereof.

The microprocessor 42 also operates in accordance with a routine such as depicted in FIG. 3 to record the time of occurrence of each door open event detected by the switch 40. The microprocessor 42 records this information in a PROM 52 in a nonvolatile fashion to obviate the need to provide a printed record. The information recorded in the PROM 52 can also be protected by a password and check sum. Because the information stored in the PROM 52 is machine readable, the microprocessor 42 may transfer the information stored in the PROM 52 via a communication interface 54 such as an RS232 interface or the like to a central station 56 which monitors the operation of one or more gaming devices. Further, the microprocessor operating in accordance with the routine depicted in FIG. 4 checks the records stored in the PROM 52 indicating the time of occurrence of each door open event to verify the records. If anomalies are discovered in the stored records, the microprocessor 42 can prevent continued operation of the gaming device and/or generate alarm signals. It is noted that although a PROM is depicted for the memory 52, other nonerasable programmable memories may be utilized such as a WORM, i.e., a write once read many memory.

As shown in FIG. 3, the microprocessor 42 proceeds from a block 60 to a block 62 upon receipt of a door open signal from the door open switch 40. At block 62, the microprocessor 42 increments a PROM address pointer to a next sequential address. At block 64 the microprocessor 42 sets the present address pointer equal to the address incremented to at block 62 and at block 66, the microprocessor 42 stores the present address pointer. At block 68 the microprocessor 42 records the date and time of the detected door opening in the PROM 52 at the address of the present address pointer. Thus, the microprocessor 42 in accordance with the routine depicted in FIG. 3 records the time of occurrence of each door opening in a sequential manner in the PROM 52. This allows the microprocessor 42 operating in accordance with the routine depicted in FIG. 4 to verify the information stored in the PROM 52 to determine if the information stored is indeed sequential and in the past.

More particularly, the microprocessor 42 at a block 72 first initializes a variable y to 0. Thereafter, at block 74, the microprocessor 42 reads the date and time information stored at the address $A_y$ in PROM 52 and at block 76 reads the date and time information stored at the next sequential PROM address $A_{y+1}$. Thereafter, the microprocessor 42 at block 78 determines whether the date stored at the address $A_y$ is earlier than the date stored at the next sequential location. If it is, the microprocessor proceeds to block 86 to increment y so that the data stored at the next sequential PROM address can be verified against the data stored at the preceding PROM address. If the microprocessor 10 determines at block 78 that the date stored at the address $A_y$ is not earlier than the date stored at the next sequential address, the microprocessor proceeds to block 80 to determine whether the date stored at the address $A_y$ is equal to the date stored at that next sequential address. If the microprocessor determines at block 80 that the two dates are not equal, the microprocessor 10 proceeds to block 82 to set an alarm flag to which the microprocessor 42 may respond to by halting the operation of the gaming device or by generating an alarm signal. If the microprocessor 42 determines at block 80 that the two dates being compared are equal, the microprocessor proceeds to block 84 to determine whether the time stored at the address $A_y$ is earlier than the time stored at the next sequential address. If the time stored at the address $A_y$ is not earlier than the time stored at the next sequential address, the microprocessor 42 proceeds to block 82 to set the alarm flag. Otherwise, the microprocessor 42 proceeds to block 6 to increment the variable y. After incrementing the variable y at block 86, the microprocessor 42 proceeds to block 88 to determine whether all of the information stored in the PROM 52 has been checked and if so, the microprocessor 42 exits the routine at block 90.

Because access to the controls 16 of the gaming device 10 is prevented via the door 14 during a power failure, the controls 16 cannot be tampered with unless the door 14 and cabinet 12 are physically damaged in a way that is readily, visually apparent. Therefore, operation of the gaming device 10 will be halted if the controls have been tampered with during a power failure. When power is supplied to the gaming device 10, the microprocessor 42 monitors the door opening events and logs the time of occurrence in a manner to readily indicate possible tampering with the gaming device. Because the information is logged in a machine readable form as opposed to on paper, the information can readily be transferred to a central monitoring station. Further, the microprocessor 42 can itself verify the data due to the sequential nature in which the data is stored so as to prevent operation of the gaming device 10 or to generate alarms if any anomalies are detected.

Many modifications and variations of the present invention are possible in light of the above teachings. Thus it is to be understood that, within the scope of the appended claims, the invention may be practiced otherwise than as described hereinabove.

I claim:

1. In a gaming device having a cabinet housing a controller for the gaming device, the cabinet having a door through which access to the controller may be had, a system for preventing said door from being opened during a power failure comprising;

a lock member mounted relative to said cabinet and door, said lock member having a first position preventing said door from being opened and being movable to a second position to allow said door to be opened; and means operable during a power failure for interfering with said lock member to prevent movement of said lock member from said first position to said second position.

2. A gaming device as recited in claim 1 wherein said movement preventing means includes an interference member biased by a spring to interfere with said lock member and an actuator that is responsive to the application of electrical power to move said interference member out of engagement with said lock member.

3. A gaming device as recited in claim1 wherein said movement preventing means includes a solenoid with a spring-biased plunger.

4. A gaming device as recited in claim 1 further including a switch device mounted relative to said door to detect the opening of said door and to provide a door open signal in response thereto and means included in said controls responsive to a door open signal for storing in a non-erasable memory information representing the times of occurrence of the opening of said door.

5. A gaming device as recited in claim 4 wherein said information is stored in a programmable read only memory.

6. A gaming device as recited in claim 4 wherein said memory has addressable, sequential memory locations and said control means stores said information in a sequential manner.

7. A gaming device as recited in claim 6 wherein said control means includes means for verifying said information relative to said memory locations.

8. A gaming device as recited in claim 6 wherein said memory has addressable, sequential memory locations and said control means stores said information in a sequential manner.

9. In a gaming device having a cabinet housing controls for the gaming device, the cabinet having a door through which access to the controls may be had, a system for monitoring door opening events comprising:

a switch device mounted relative to said door to detect the opening of said door and provide a door open signal in response thereto; and means included in said controls responsive to a door open signal for storing in a non-erasable programmable memory information representing the time of occurrence of an opening of said door.

10. A gaming device as recited in claim 9 wherein said information is stored in a programmable read only memory.

11. A gaming device as recited in claim 8 wherein said control means includes means for verifying said information relative to said memory locations.

12. A gaming device as recited in claim 8 including means for preventing said door from being opened during a power failure.

13. A gaming device as recited in claim 12 including a lock member mounted relative to said cabinet and door, said lock member in a first position preventing said door from being opened and being movable to a second position to allow said door to be opened; and an interference member biased by a spring to interfere with said lock member, said interference member being coupled to an actuator that is responsive to the application of electrical power to move said interference member out of engagement with said lock member.

14. A gaming device as recited in claim 12 wherein said preventing means includes a solenoid having a plunger that is spring biased to interfere with said lock member during a power failure.

15. In a gaming device having a cabinet housing controls for the gaming device, the cabinet having a door through which access to the controls may be had, a door open monitoring system comprising:

means for preventing said door from being opened during a power failure; and means operable during the restoration of power for storing in a non-erasable programmable memory information representing the times of occurrence of each opening of said door.

16. A gaming device as recited in claim 15 further including means for transmitting the information stored in said memory to a remote location.

* * * * *

UNITED STATES PATENT AND TRADEMARK OFFICE

CERTIFICATE OF CORRECTION

PATENT NO. : 5,224,707

DATED : July 6, 1993

INVENTOR(S) : John R. Martin

It is certified that error appears in the above-indentified patent and that said Letters Patent is hereby corrected as shown below:

On the title page, Under Reference Cited, Patent No. "4,795,155-"9/1989 should be —1/1989—.

Column 1, line 1 - "Tne" should be --The--.

Column 1, line 1 - after "The" insert --present--.

Column 4, line 3 - "6" should be --86--.

Signed and Sealed this

Eleventh Day of April, 1995

*Attest:*

Bruce Lehman

BRUCE LEHMAN

*Attesting Officer*

*Commissioner of Patents and Trademarks*